United States Patent [19]

Chevalier

[11] Patent Number: 4,557,538

[45] Date of Patent: Dec. 10, 1985

[54] ASSEMBLY FOR EFFECTING AN ELECTRIC CONNECTION THROUGH A PIPE FORMED OF SEVERAL ELEMENTS

[75] Inventor: André Chevalier, Pantin, France

[73] Assignee: Institut Francais du Petrole, France

[21] Appl. No.: 515,978

[22] Filed: Jul. 21, 1983

[30] Foreign Application Priority Data

Jul. 21, 1982 [FR] France ..... 82 12861

[51] Int. Cl.[4] ..... H01R 4/64

[52] U.S. Cl. ..... 339/16 C; 339/16 RC; 339/94 M

[58] Field of Search ..... 339/15, 16 R, 16 C, 339/16 RC, 59 R, 59 M, 60 R, 60 M, 61 R, 61 C, 61 M, 94 R, 94 M, 45 R, 45 M; 174/47; 73/151; 175/104; 324/354–356; 340/853, 856–858; 367/81, 82; 285/18, 24, 27, 237, 305, 317, 331, 423, DIG. 23; 166/65 R, 378–380

[56] References Cited

U.S. PATENT DOCUMENTS

| | | | |
|---|---|---|---|
| Re. 11,924 | 7/1901 | Sargent | 339/16 R |
| 2,178,931 | 11/1939 | Crites et al. | 339/16 R |
| 2,320,367 | 6/1943 | Leathers | 339/16 R |
| 2,744,771 | 5/1956 | Laurent | 285/18 |
| 3,051,244 | 8/1962 | Litchfield | 285/18 X |
| 3,193,308 | 7/1965 | Todd | 285/18 |
| 4,079,968 | 3/1978 | Wilkins, Jr. | 285/317 X |
| 4,176,894 | 12/1979 | Godbey | 339/94 R X |
| 4,445,734 | 5/1984 | Cunningham | 339/16 C |
| 4,496,203 | 1/1985 | Meadows | 339/16 C |

*Primary Examiner*—Gil Weidenfeld
*Assistant Examiner*—Steven C. Bishop
*Attorney, Agent, or Firm*—Antonelli, Terry & Wands

[57] ABSTRACT

An electric connection between conductors of two pipe elements to be joined through male-female junction, with the conductors being housed in internal sheaths of the pipe elements, is effected by an assembly of three connectors, one connected to the male side of each element, another connected to the female side thereof and a double connector adapted to electrically connect the male side connector of a pipe element with the female side connector of an adjacent joined pipe element.

20 Claims, 6 Drawing Figures

10
60
61
63
62
16
15a
5a
55a
55
10
11
58
29
27
51
25
26
40
41
5b
15b
24
30
31
14
39
13
36
37
57
32
59
19
20
17
12
18
23
22
21
16
15a
5a

ASSEMBLY FOR EFFECTING AN ELECTRIC CONNECTION THROUGH A PIPE FORMED OF SEVERAL ELEMENTS

The present invention concerns an assembly for effecting at least one electrical connection between two points through a pipe; such an electric connection may be used in particular for the electric supply of certain apparatuses from an electric source or for transmitting informations coded as electric signals.

This assembly may be used for example in a drill string. It will then be used to transmit from the hole bottom certain informations, electrically coded, such as, for example, the orientation of the well, the mechanical stresses to which are subjected certain parts, the temperature, the pressure, etc.

The devices used according to the prior art, which may be illustrated by the U.S. Pat. Nos. 2,096,359; 3,518,609; 3,696,332 and 3,879,097, and German patent or patent applications Nos. 1,236,439 and 1,465,924, and the British patent application No. 1,026,512, suffer generally from at least one of the four main disadvantages stated hereinafter.

The first disadvantage is the consequence of the location of the electric contact surface in a plane at the base of the string or of the pipe element. As a matter of fact, in these conditions, during the storage, in vertical position, of the elements forming the pipe, the electric contact surface becomes foul, striated and quickly damaged by contact with the ground.

The second disadvantage occurs as a result of the wire or cable used for the electric connection being placed inside the pipe, so that the actual residual passage section is no longer the same as the initial passage section, thus, in this case of a pipe of an initially circular passage section, the use of a conductor cable makes the actual passage section different from a circle.

This may hinder some operations such as passing and centering a tool into the pipe, the more as the angular position of the cable with respect to the pipe is not steady.

The third disadvantage is due to the lack, in the prior art, of a simple and efficient device for cleaning electric contacts.

Finally, the fourth disadvantage is due to the wear of different elements taking part to the connection, as the result of numerous assemblings and disassemblings.

These disadvantages are avoided, or at least reduced to a very large extent, by the use of the device according to the invention.

This device consists of an assembly for effecting at least one electric connection through a pipe formed of interconnected elements, each element having a first end and a second end adapted to mechanically co-operate with complementary ends of adjacent pipe elements. This assembly comprises for each pipe element:

a sheath having two ends, placed inside the pipe element, and wherein is housed at least one conductor;

a first connector secured to one end of the sheath which is maintained in the first end of the pipe element and which electrically co-operates with the conductor;

a second connector secured to the other end of the sheath, which is maintained in second end of pipe element and which electrically co-operates with the conductor;

a double connector having a first end comprising at least one contact and a second end comprising at least one contact electrically connected to the preceding one, the first end of the double connector electrically co-operating with the first connector of an adjacent pipe element, the second end of the double connector electrically co-operating with the second connector; and means for positioning and fastening the connectors.

According to an embodiment of the invention, the double connector is a wearing part made of materials softer than those of the parts with which it co-operates, with the double connector being easily detachable.

Moreover, devices are provided for the automatic cleaning and insulation of the different electric contacts when assembling two adjacent pipe elements.

According to the invention, the fact of placing the conductor in the sheath makes it possible to control the actual passage section of the pipe. It is possible in particular, by this way, to avoid the above-mentioned disadvantages of the prior art devices, by obtaining a circular passage section for the fluid.

An example of embodiment of the invention, more particularly applied to the drill strings, is described hereinafter with reference to the accompanying drawings wherein.

In order to facilitate an understanding of the following example, the type of the different connectors has been set. Thus, the first connector will be a connector of male type, the second connector a female connector, the double connector, called intermediary connector, will have a first female end and a second male end. Similarly, the first end of the pipe will be a male end and the second end of said pipe, a female end. It is quite obvious that the above-mentioned details are by no way limitative and that it is possible to have mixed connectors, i.e. for example in the case of a double electric connection, connectors comprising a contact of the female type and a contact of the male type.

Figure 1:
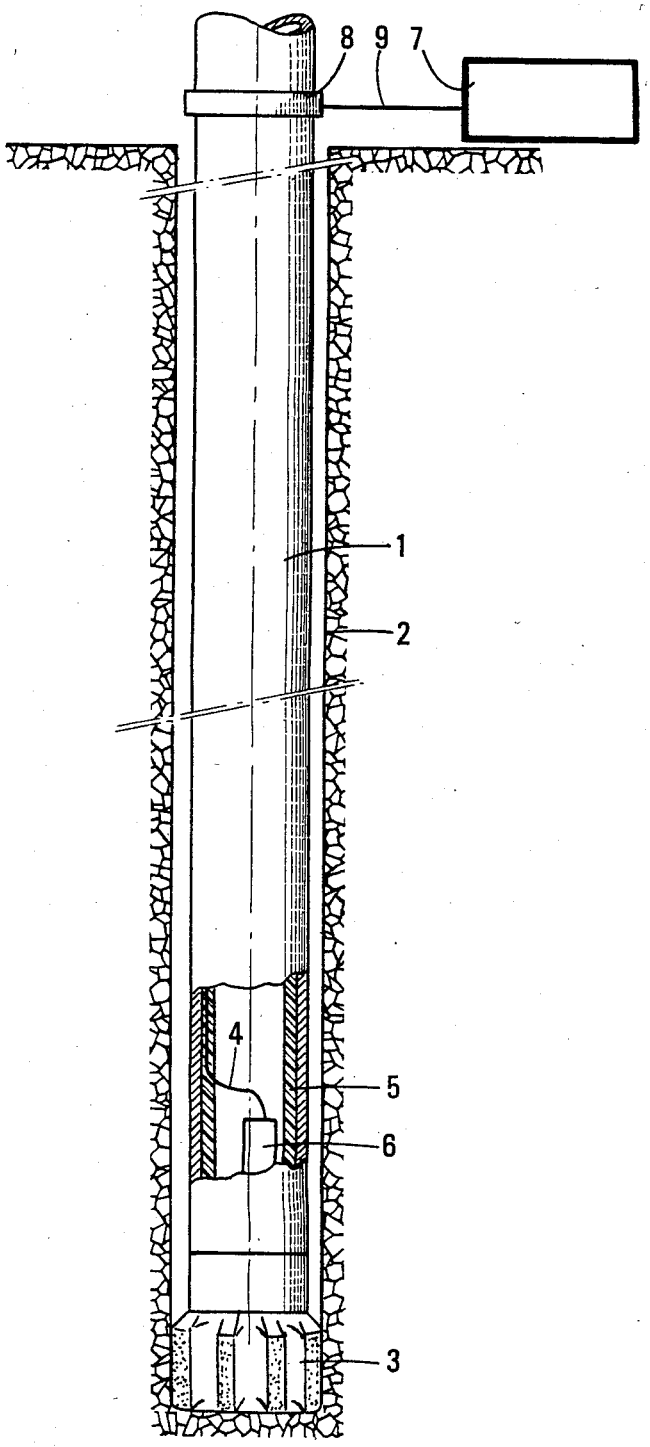
FIG. 1 is a longitudinal view of an embodiment of the invention applied to a drill string disposed in a well bore.
Figures 2, 5:
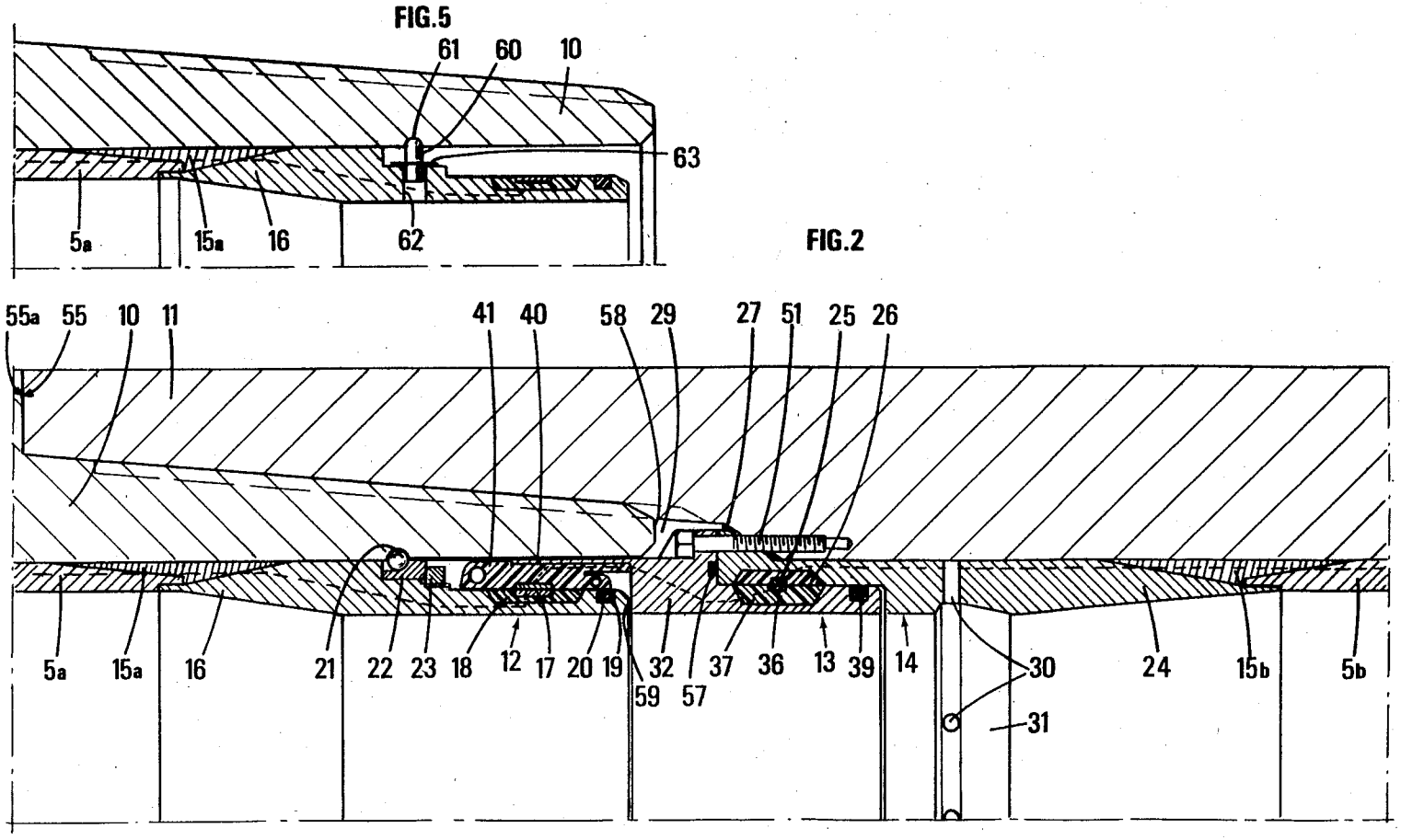
FIG. 2 shows two elements of a pipe, equipped with the connection assembly and connected to each other.
FIG. 5 shows an alternative embodiment of the positioning and fastening means.

As shown in FIG. 1 an embodiment of the invention is applied to a drill string 1, disclosed in a well bore 2, with a drill tool 3 which may be replaced by any tool or by a measuring sonde. The junction between the different elements forming the drill string is now shown in FIG. 1; however, FIG. 2 provides an example of this junction.

It is of course possible in certain cases to make use of the drill string, the ground or the muds as electrically conducting medium. This makes possible to form an electric circuit by using only a single electric conductor insulated in a sheath. This case of a single conductor will be precisely that described in detail hereinafter, but the invention is also applicable to the case of several conductors.

In FIG. 1, the electric conductor 4 is embedded within the mass of an internal sheath 5 of the pipe. The electric conductor 4 may be equipped with its own insulation, particularly when the sheath 5 has an insufficient electric insulation.

In FIG. 1, the conductor 4 connects an apparatus 6 to a surface installation 7, with these two assemblies electrically co-operating with each other. It is possible to make use of the assembly for effecting the electric connection according to the invention, even when the drill string 1 rotates. This can be achieved by the provision of at least one rotating contact which may consist, for example, of a ring 8 electrically co-operating with a contact member 9, such devices being known in the prior art, will not be described in detail in the present specification.

In the junction in FIG. 2 between two adjacent pipe elements, each of these elements is equipped with different part providing for the electric connection. In FIG. 2, the two pipe elements are screwed to each other. The invention is applicable to any type of connection by screwing or otherwise, inasmuch as the interconnecting operation of the different elements involves at least an axial displacement.

The male side 10 of a pipe element is screwed on the female side 11 of the next pipe element. References 5*a* and 5*b*, respectively, designate the sheath containing the electric conductor on the male side of the pipe element and of the female side of the next element.

The connection assembly comprises, in addition to the sheath 5, a male connector generally designated by the reference numeral 12, an intermediary connector generally designated by the reference numeral 13, a female connector generally designated by the reference numeral 14, as well as fastening means.

The mechanical joining between the male connector 12 and the sheath 5*a* or between the female connector 14 and the sheath 5*b* may be effected, according to the nature of used materials, by moulding, for example by curing, or by casting of thermosetting resins or still by welding or by any other means. This joining, designated respectively by 15*a* and 15*b*, is effected after having electrically connected the ends of the conductor wire 4 housed into the sheath 5, respectively with the conductors of connectors 12 and 14.

The male connector 12 comprises a body 16 provided with a passageway for an electric conductor, a recess for housing a contact member 17 which, in the case of FIG. 2, is embedded, at least partially, within a thermosetting resin layer 18, a groove 19, destined to accomodate a joint 20, used for drying the contact member 42 and optionally for making tight the compartment containing contacts 17 and 42, as well as positioning and fastening means. The latter may comprise a ball 21 which is partially housed into a housing arranged within the male side 10 of the pipe element, a part 22 maintaining the ball 21 in its housing, this part 22 being itself secured to the male connector 16 through a bolt 23. After its positioning, the part 22 is in abutment against the ball 21 and thus effects the axial and angular positioning of the male connector. In order to facilitate the disassembling of the male connector, it is possible to provide the part 22 with a bore, threaded cover at least a certain length. This bore, parallel to the pipe axis and passing throughout the part 22, is so positioned as to face a solid rigid part of the male connector, so that a force is applied which tends to disengage the part 22 from the male connector, by screwing a bolt of sufficient length within said bore.

According to the embodiment of FIG. 5, the positioning and fastening means may comprise a pin 60 co-operating with a housing 61 provided inside the pipe element, on the male side 10, and with a bore 62, provided in the first connector 12. The pin 60 may comprise a circular groove co-operating with a retainer member 63, such as a "circlip" or a pin. Other devices for maintaining the pin in position may be used, these devices being known in the art will not be described more in detail.

The female connector 14 comprises a body 24, provided with a passageway for an electric conductor, a recess for housing a contact 25, which, in the case of FIG. 2, is embedded at least partially into a layer of thermosetting resin 26, positioning means consisting, for example, of spacers 27 as well as fastening means such as conical pins 28. The body 24 of the female connector may comprise grooves on its external surface whereby compartment 29 is connected with the inside of the sheath via orifices 30. It will not be outside the scope of the present invention to provide grooves and orifices in the first connector 12. These orifices may advantageously open in one or more cavities 31 adapted, by their shape, to minimize the pressure drops while protecting the edges of orifices 30 which, otherwise, would tend to become quickly worn. Finally the body 24 of the connector comprises a flared part co-operating with the inner shoulder on the female side of the pipe element.

Figure 3:
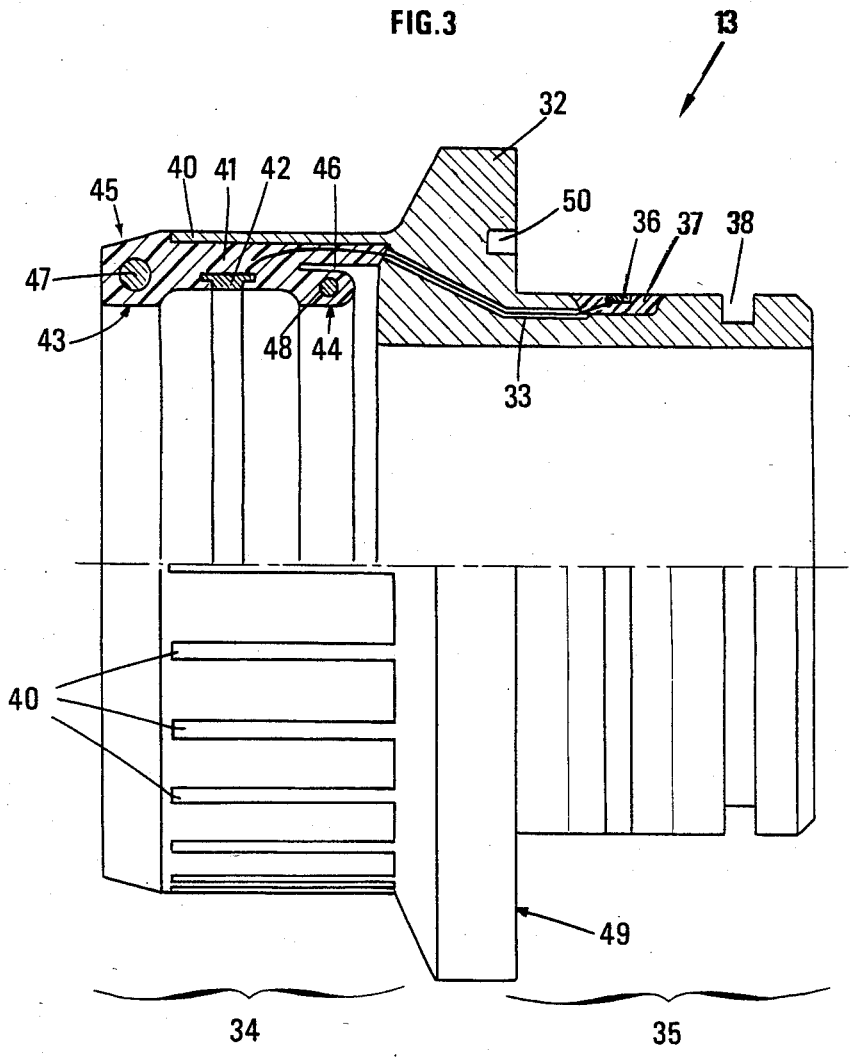
FIG. 3 represents the detachable double connector.

The intermediary connector 13 comprises a body 32 provided with a passageway 33 for the conductor connecting the contact 42 on the female side 34 (see FIG. 3) of the same conductor. The male side 35 of the intermediary connector comprises a recess in its external wall to house a contact 36 which, in the case of FIGS. 2 and 3, is at least partially embedded within an elastomer layer 37, as well as a groove 38 destined to accommodate a seal joint 39, optionally of the drying type. The body 32 of the intermediary connector is ended on the female side 34 by leaves 40, carrying a part advantageously made of elastomer 41 wherein is housed the contact member 42. The part 41 of elastomer comprises two lips, one called upper lip 43, the other lower lip 44, providing for the drying and sealing effects. The leaves 40 act as straighteners and avoid the flow of elastomer forming the part 41. Similarly, reinforcing elements 47 and 48, confer to the lips a permanent elasticity. These reinforcing elements may, for example, consist of springs, split rings etc.

In some cases, it is necessary to provide free spaces 45 and 46 behind the lips so as to accommodate the deformation of the elastomer when introducing the male connector, without generating any substantial mechanical stress.

The body 32 of the intermediary connector comprises a shoulder 49 which co-operates with the upper face of the female connector 14 and a groove 50, destined to accommodate a seal joint 57, is provided in shoulder 49.

The intermediary connector 13 may be maintained bearing against the female connector by bolts 51 passing through the female connector and screwed on the pipe female element 11.

Figure 4:
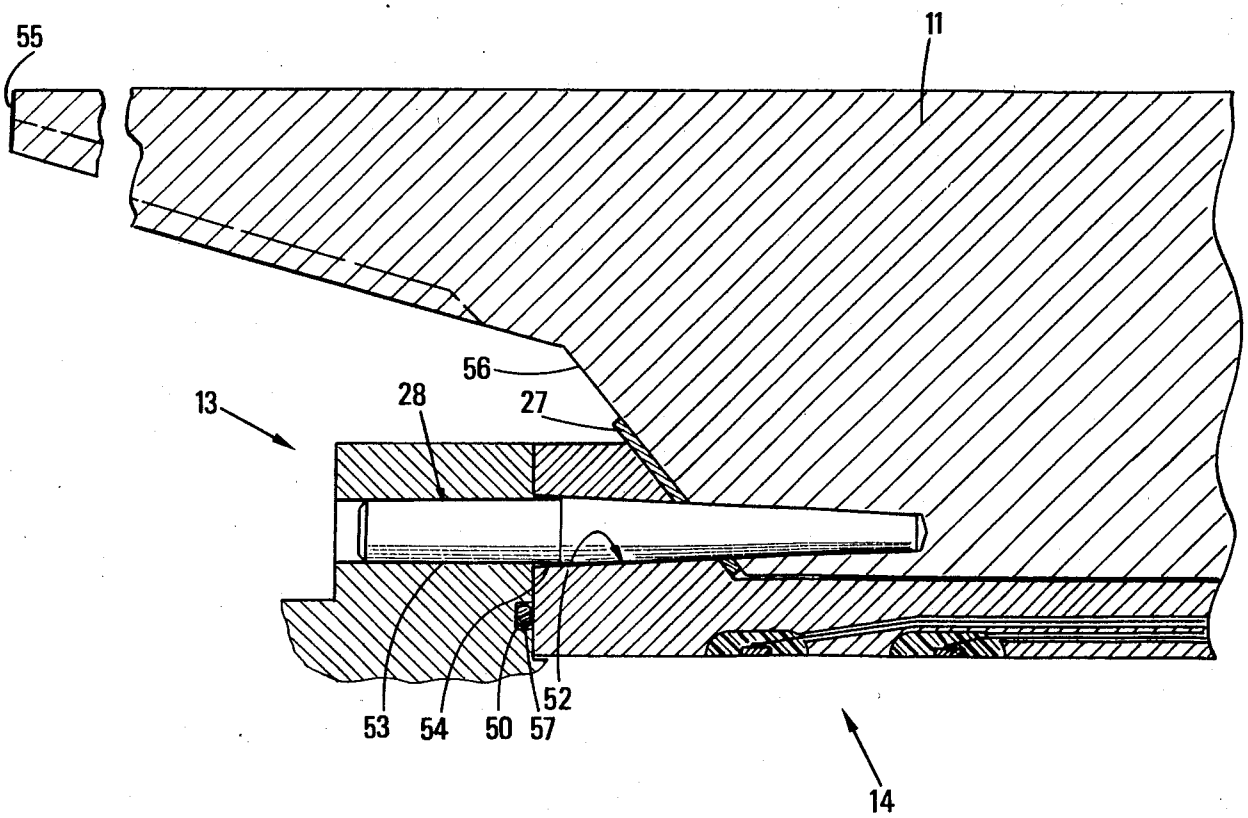
FIG. 4 illustrates a detail of the fastening of the second connector by means of a special bolt used for centering the double connector.
Figure 6:
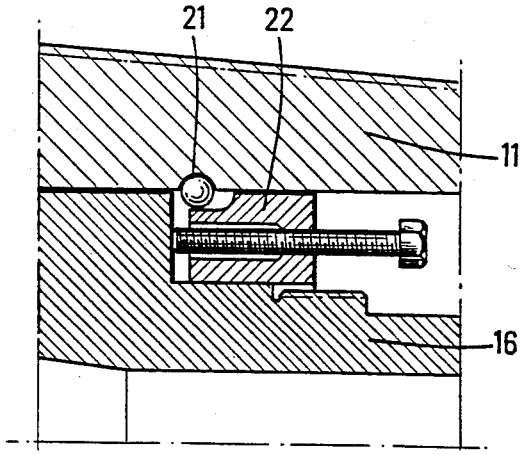
FIG. 6 is an enlarged view of the positioning and fastening means shown in FIG. 2.

The axial positioning of the intermediary connector is effected through the shoulder 49 which co-operates with the upper face of the female connector 14. The angular positioning may be effected by centering studs which co-operate with housings respectively provided in the female connector 14 and in the intermediary connector 13. Another possible solution for angularly positioning the intermediary connector is illustrated in FIG. 4. According to this embodiment, a pin 28 is used which has a conical part 52 and a cylindrical extension 53 acting as a centering stud for the bores hollowed out in the intermediary connector 13. The conical part 52 of the pin 28 takes its bearing on a conical bore 54 in the female connector 14 as well as in the female side 11 of the pipe element, so as to maintain the latter in position. The pin 28 maintains the connector 14 in position when disassembling the intermediary connector 13.

The number of electric connections to effect, which was only one in the preceding case, may be increased. Thus, FIG. 4 illustrates the case of a female connector for a double electric connection.

In the case where the relative angular position of the pipe elements with respect to one another is defined, it is possible to effect several contacts on a single circumference, axial lips, for example, electrically insulating the different contacts.

According to the invention, in the case where several electric connections are effected, it is possible to have a distribution of the female connector contacts different from that of the male connector contacts. For example, when it is desired to effect two electric connections, it is possible to make use of two angular contacts located in different planes on the male connector and two contacts, each having the shape of an arc of circle, located in the same plane but electrically insulated from each other, on the female connector.

According to the invention, it is possible to coat at least certain parts of the connectors exposed to the flow with an antiwear material.

Finally, the number of conductors used for the electric connection may be more than one, thus decreasing the risk of failure.

EXAMPLES OF A METHOD FOR POSITIONING THE ASSEMBLY ACCORDING TO THE INVENTION

The two following examples are by no way limitative.

FIRST EXAMPLE

This example concerns the case where the different manufacturing tolerances for the different constituting elements are identical in order to be able to equip all of them with sheaths having conductors 5*a*, 5*b* of same length It is then advantageous to first assemble the female connector, the sheath and the male connector. Then, it suffices to draw the male connector into the pipe element to be equipped until the flared part of the female connector comes in abutment against the shoulder provided on the female side of the pipe element, to position the pins 28, to lock the male connector onto the pipe element for instance by means of the ball 21, the blocking member 22 and the bolt 23, and to place the intermediary connector and secure it by screws 51.

SECOND EXAMPLE

Case where the manufacturing tolerances for the different elements forming the pipe are not identical so that they cannot be all equipped with sheaths 5*a*, 5*b* of the same length.

It is then advantageous to make use of female connectors already equipped with sheaths comprising conductors of a length greater than or identical to that required for equipping the longer pipe element. With this provision, the procedure is as follows:

the length between the shoulder 55 and the shoulder 56 of frusto-conical shape is measured. The measured value determines the thickness of the spacer 27 to be used so that the distance between the contacts 25 of the shoulder 55 of the pipe element on the female side 11 be identical for all the pipe elements;

the sheath 5*b*, equipped with the female connector 14, is introduced, at the female side 11, into the pipe element and the sheath is pulled off until the female connector be in position; it is then possible to determine the actual dimension to be given to the conducting sheath 5*b*, so that the distance between the contact member 17 of the shoulder 55*a* of the pipe element, on the male side 10, be identical for all the pipe elements;

this assembly is withdrawn from the pipe element and it is cut out at the precedingly determined dimension;

the electric connection between the male connector and the free end of the conducting sheath is effected and followed with an appropriate junction between these two parts; and further operations can then be effected as indicated in the first example, without omitting the spacer 27.

During the fitting of the intermediary connector 13 with the connector 14, the joint 39 may achieve a drying or wiping out of contacts 25. However, the essential purpose of this joint 39 as well as that of joint 57 is to achieve the sealing of contacts 25 and 36. As a matter of fact, these parts being diassembled only for the replacement of the intermediary connector, it suffices to take care of the contact cleanness before the operation which, upon the whole, does not occur frequently.

During the fitting between the male connector 12 and the intermediary connector 13, the joint 20 achieves the drying and the wiping out of contact 42, whereas the upper lip 43 provides for the drying and cleaning of contact 17 of the male connector. At the end of the operation, the upper lip 43 as well as the lower lip 44 achieve the tightness of the contact between the male connector and the intermediary connector, said tightness being optionally enhanced by the use of reinforcing elements 47 and 48.

The relative motions of the male connector with respect to the intermediary connector have but little effect on the drying of the contacts, as soon as it does exist as a whole a translation movement of one part with respect to the other. It is immaterial that the latter be combined with a continuous or alternating rotation movement.

It must be stated that the position of the male contact 12 with respect to the shoulder 55*a* is calculated in relation with accepted tolerance over the distance separating said shoulder 55*a* from the top 58 of the considered pipe element, so that, when said distance has the minimum value, the lower part 59 of the male connector does not project beyond the upper face 58 of the considered pipe element. Thus, during the vertical storage of pipe elements, as the face 58 rests on the ground, the male connectors are not damaged. The same is true on the feame side of the pipe element, the dimensions of the intermediary connector being calculated so that it does not project beyond the pipe element.

In order to replace the intermediary connector 13, it suffices to unscrew the screws 51 to release it, the female connector being kept in position by means of pins 28 and balls 21.

The sheath 5 may be made of the material sold under the trade mark "Rilsan" (well known in the art) which exhibits excellent mechanical properties. The electric conductor may be placed in a groove provided along the sheath.

In order to facilitate the connection between the sheath and the connectors 12 and 14, it is possible, in certain cases, to secure metal sleeves to the ends of the sheath by an appropriate process. When the connectors comprise a metal part, it then becomes possible to weld the connectors to the sleeves.

Of course, in the case where the length of the sheath has to be adjusted to that of the pipe element, it is possible either to adapt the length of the sheath itself or that of at least one of the sleeves or, when the sheath is already equipped with at least one sleeve of fixed length, to add an additional sleeve to complement the length.

This last solution makes it possible to use elements of standard length such as sheaths, or sheaths equipped with sleeves, this being of particular interest from an economical point of view.

What is claimed is:

1. An assembly for effecting at least one electric connection through one pipe formed of a plurality of pipe elements secured to one another, each pipe element having a first end and a second end, adapted to mechanically cooperate with the complimentary ends of the next elements, characterized in that each pipe element comprises:

a sheath placed inside said element and wherein is housed at least one conductor, a first connected secured to one end of said sheath which is maintained in the first end of said pipe element and which electrically cooperates with said conductor, a second connector secured to the other end of said sheath which is maintained in the second end of said pipe element and which electrically cooperates with said conductor, a double connector having a first end comprising at least one contact and a second end comprising at least one contact, said contacts being electrically connected to one another, the first end of said double connector electrically cooperating with the first connector of an adjacent pipe element, the second end of the double connector electrically cooperating with said second connector, and means for positioning and fastening said first and second connectors to said pipe element.

2. An assembly according to claim 1, wherein said second connector is placed and maintained in position in said pipe element by a pin having a certain length of conical shape and cooperating with a first conical bore provided in said second connector and with a second conical bore provided in said pipe element.

3. An assembly according to claim 2, wherein said pin is surmounted with a cylindrical part providing for the positioning of the double connector.

4. An assembly according to claim 1, wherein at least one of the second connector or the first connector is provided with at least one external groove connected to at least one hole, said hole extending through said at least one first or second connectors for achieving a pressure balance within the space defined by two complimentary ends of adjacent elements and by different parts allowing the electric connection with an interior of the pipe.

5. An assembly according to claim 4, wherein said at least one hole opens in a cavity having a shape adapted to reduce the wear of edges of said at least one hole.

6. An assembly according to claim 5, wherein a plurality of holes are provided along a same diameter, said plurality of holes opening into a cylindrical groove having a flat bottom and two sides at least one of which has a gentle slope.

7. An assembly according to claim 1, wherein the second connector is made of a rigid material to which is secured at least one conducting ring maintained in position by one of a thermal setting resin or elastomer.

8. An assembly according to claim 1, wherein the second connector at an upper part not secured to said other end of said sheath has a diameter larger than a smaller inner diameter of the pipe.

9. An assembly according to claim 1, wherein an external diameter of the first connector is at most equal to a smaller inner diameter of the pipe.

10. An assembly according to claim 1, wherein the means for positioning and fastening the first connector comprises at least one ball partially housed in a cavity provided inside the first end of the pipe element, at least one part maintaining said ball in said cavity, said part being maintained on the first connector by a bolt.

11. An assembly according to claim 10, wherein said part maintaining said ball comprises a bore throughout said part, said bore being threaded over at least a certain portion of a length thereof and being so positioned so as to face a solid rigid part of the first connector so that a force is applied which tends to disengage said part from the first connector when threadably inserting a bolt of sufficient length into said bore.

12. An assembly according to claim 1, wherein said double connector is maintained applied against said second connector through at least one screw screwing on the second end of the pipe element.

13. An assembly according to claim 1, wherein said double connector comprises housings receiving joints provided for the sealing of the electric contact between said double connector and the second connector.

14. An assembly according to claim 1, wherein the first end of the double connector is made of an elastomer comprising reinforcing elements.

15. An assembly according to claim 1, wherein the first end of the double connector comprises lips for drying and sealing of the electric contacts between the double connector and the first connector.

16. An assembly according to claim 15, wherein the first end of the double connector comprises free spaces in a vicinity of the lips, said free spaces being adapted to accommodate a volume of material displaced by a rearward movement of the lips when introducing the first connector.

17. An assembly according to claim 1, wherein the positioning of the second connector is effected by spacers interposed between the pipe element and said second connector.

18. An assembly according to claim 1, wherein the first connector comprises at least one housing adapted to receive a joint means for at least one of drying and sealing of the electric contact.

19. An assembly according to claim 1, wherein at least certain parts of at least one of said first, second, and double connectors exposed to are coated with antiwear material.

20. An assembly according to claim 1, wherein the means for positioning and fastening the first connector to the pipe element comprises at least one pin cooperating with a housing provided inside the pipe element and with a bore provided in the first connector and a retaining member.

* * * * *